US007038974B2

(12) United States Patent
Dalloz

(10) Patent No.: US 7,038,974 B2
(45) Date of Patent: May 2, 2006

(54) TIMEPIECE COMPRISING AND ANNUAL OR PERPETUAL DATE DISPLAY MECHANISM

(75) Inventor: Jean-Pierre Dalloz, Lavans les Saint-Claude (FR)

(73) Assignee: Daniel Roth & Gerald Genta Haute Horlogerie S.A., Meyrin (CH)

( * ) Notice: Subject to any disclaimer, the term of this patent is extended or adjusted under 35 U.S.C. 154(b) by 6 days.

(21) Appl. No.: 10/952,271

(22) Filed: Sep. 28, 2004

(65) Prior Publication Data

US 2005/0078558 A1 Apr. 14, 2005

(30) Foreign Application Priority Data

Oct. 13, 2003 (EP) ..... 03405732

(51) Int. Cl.
*G04B 19/24* (2006.01)

(52) U.S. Cl. ..... 368/28; 368/37

(58) Field of Classification Search ..... 368/28, 368/31–40, 80

See application file for complete search history.

(56) References Cited

U.S. PATENT DOCUMENTS

| | | | | |
|---|---|---|---|---|
| 864,177 | A * | 8/1907 | Mantaras | 368/220 |
| 3,696,609 | A * | 10/1972 | Dubois | 368/220 |
| 3,750,380 | A | 8/1973 | Kocher | |
| 5,184,333 | A | 2/1993 | Caspar | |
| 5,943,299 | A * | 8/1999 | Genta | 368/28 |
| D423,953 | S * | 5/2000 | Kauffmann | D10/39 |
| 6,327,226 | B1 * | 12/2001 | Russi | 368/228 |
| 2003/0103416 | A1 * | 6/2003 | Gabathuler et al. | 368/28 |

FOREIGN PATENT DOCUMENTS

| | | |
|---|---|---|
| CH | 666591 | 8/1988 |
| FR | 793442 | 1/1936 |

* cited by examiner

*Primary Examiner*—Kamand Cuneo
*Assistant Examiner*—Thanh S. Phan
(74) *Attorney, Agent, or Firm*—Sturm & Fix LLP

(57) ABSTRACT

This timepiece comprises an annual or perpetual date display mechanism and also comprises means (11) for operating a device (13) for displaying the number of days in the month being displayed.

8 Claims, 2 Drawing Sheets

TIMEPIECE COMPRISING AND ANNUAL OR PERPETUAL DATE DISPLAY MECHANISM

CROSS REFERENCE TO RELATED APPLICATIONS

This application is claims priority of European Application No. 03405732.3 filed Oct. 13, 2003, which is included in its entirety by reference made hereto.

BACKGROUND OF THE INVENTION

1. Field of the Invention

The present invention relates to a timepiece comprising an annual or perpetual date display mechanism.

2. Description of Related Art

Known annual or perpetual date display mechanisms generally comprise an indication of the current month and the day of the week, in addition to the indication of the date. This information on the division of time, based on the period of rotation of the earth around the sun, is sometimes supplemented by information concerning the position of other celestial bodies, particularly the moon, with respect to the earth.

Although any annual or perpetual date mechanism necessarily comprises a month cam to determine the number of days in the month being displayed, none of these mechanisms has a display device for indicating the number of days in the month being displayed. However, this information is extremely useful in everyday life.

CH 538137 proposes a date mechanism indicating the days in the months. This mechanism is in fact a simple date mechanism in which the user, by moving a disc or a plate at any time during the month, sets the mechanism to skip from the last days of the month to the 1st of the next month. It therefore makes the correction before and not afterwards. This is why the number of days in the month is indicated. It enables the user to know whether the mechanism is in the correct position for changing from the 28th, 29th, 30th or 31st to the 1st of the next month. The purpose is therefore not to indicate the number of days in the month, but to show whether the date mechanism has been set to the correct position. In the case of this mechanism, therefore, the number of days in the month has to be indicated by the user; the mechanism does not do this automatically. In fact, since the correction is made manually and can be made at any time during the current month, the indicated number 28, 29, 30 or 31 does not mean that the month has the number of days indicated, since the change is not automatic. By contrast with conventional simple date mechanisms in which the user has to change the date five times per year, in this case he has to change it ten times per year, since he also has to move the disc from 30 to 31 days, failing which the date mechanism will skip the 31st day of the 31-day month following a 30-day month, whereas in a simple date mechanism the 31st is always indicated by default and therefore requires no correction.

BRIEF SUMMARY OF THE INVENTION

The object of the present invention is to permit the use of this display potential which has not been exploited up to the present.

For this purpose, this invention proposes a timepiece comprising an annual or perpetual date display according to claim 1.

The essential advantage of this invention is that it offers the display of a supplementary indication which has not been available hitherto for annual or perpetual date display mechanisms.

Preferably, the means for operating the display device of this timepiece comprise a driving yoke for an indicator of this display device, a month cam of the date mechanism, a spring for pressing the driving yoke against the month cam and a linkage between the indicator element and the driving yoke.

This device contains very few parts and is therefore simple and reliable.

Other characteristics of this invention will become clear from the following description which refers to the attached drawing which illustrates, schematically and by way of example, one embodiment of the timepiece according to the invention.

DETAILED DESCRIPTION OF THE INVENTION

Figure 1:
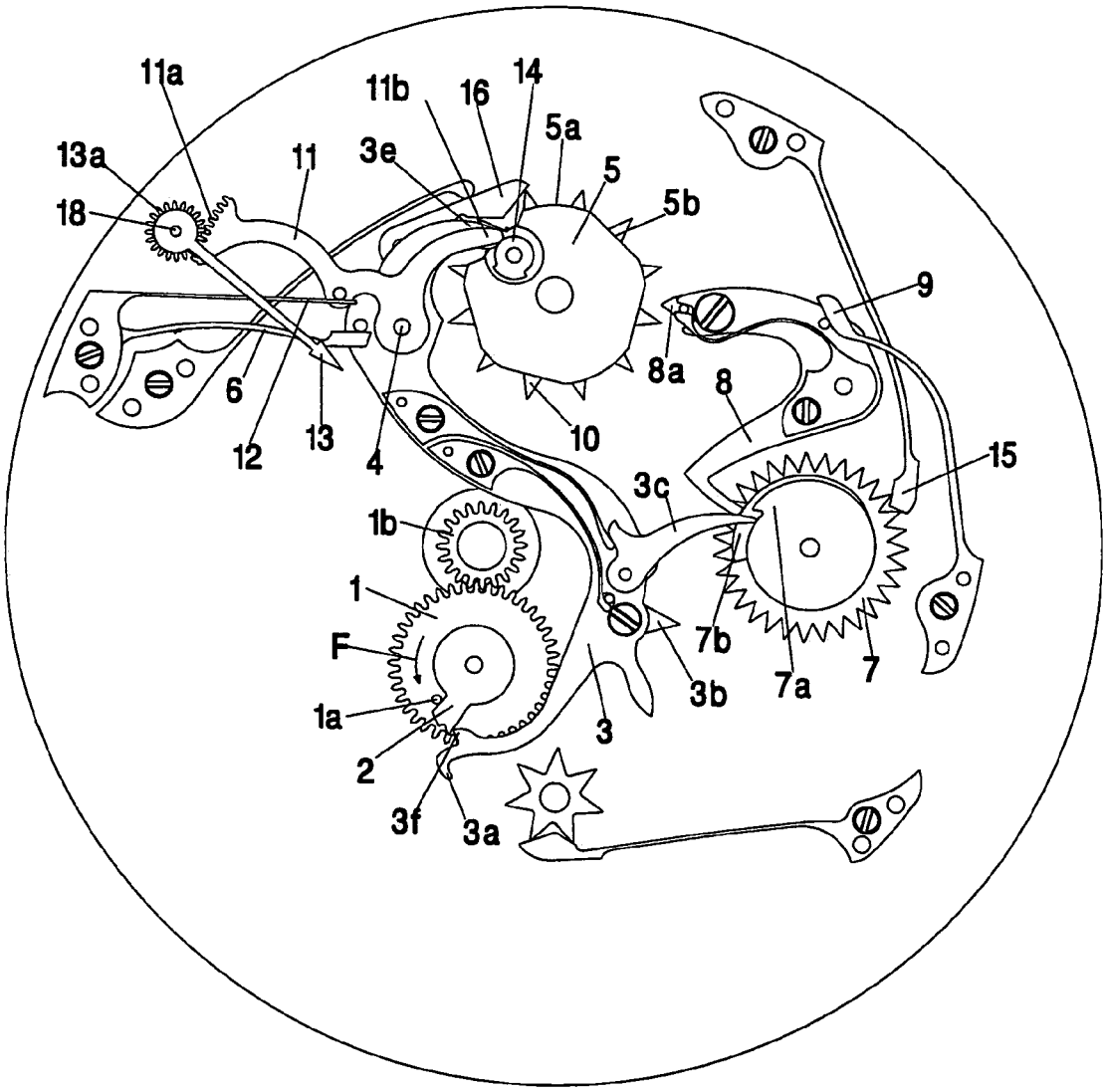
FIG. 1 is a plan view of the perpetual calendar mechanism of this timepiece.

The calendar mechanism of the timepiece according to the present invention comprises an operating wheel 1, driven through one revolution in 24 hours in the direction of the arrow F by the hour wheel 1*b* of the motion work of the timepiece. This operating wheel 1 carries a pin la which serves to drive a finger 2 mounted pivotably on the same shaft as the operating wheel 1.

A large yoke 3 is mounted pivotably about a shaft 4 and is pressed against a month cam 5 by a spring 6 which tends to make this large yoke 3 turn about this shaft 4 in a clockwise direction. This large yoke 3 serves to operate the principal functions of the calendar. For this purpose, it comprises an actuating tip 3*a* of the days of the week, a first drive pawl 3*b* of a date wheel 7 positioned by a catch 15 which has 31 teeth, as well as a large pawl 3*c* which interacts with a decreasing correction cam 7*a*, fixed to the date wheel 7.

This date wheel 7 carries a second decreasing cam 7*b* on which a yoke 8 bears under the pressure of a spring 9.

This yoke 8 carries a paw 8*a* to drive a year wheel 10, positioned by a catch 16 fixed to the month cam 5. This year wheel 10 has twelve teeth and is driven by one step for each revolution of the date wheel 7, so that it carries out one revolution per year.

A second yoke 11 is pressed by a spring 12 against the month cam 5. This second yoke 11 has a toothed sector 11*a* engaged with a pinion 13*a* coaxial with an indicator element 13 of the device for displaying the number of days in the month being displayed, mounted pivotably on a shaft 18.

The month cam 5, like practically all month cams of perpetual date mechanisms, comprises nine angular portions formed by an alternation of segments of a circle 5*a* centred on the shaft of the year wheel 10 and straight portions 5*b* tangent to a circle of smaller diameter, in such a way that these segments of a circle 5*a* and these portions of straight lines 5*b* alternately determine two corresponding positions of the second yoke 11 and therefore also determine two corresponding angular positions of the indicator element 13, according to whether the month being displayed has 30 or 31 days.

Where the month of February is concerned, the cam 5 is replaced by a cam 14 which is fixed to a satellite pinion located under the year wheel 10 and which engages with a fixed pinion coaxial with this year wheel 10. This cam 14 has two segments, one with a large diameter for displaying February as a 29-day month, extending over 90°, and the other, with a smaller diameter, for displaying February as a 28-day month, extending over 270°. This cam 14 is keyed on the shaft of its satellite pinion so that the portion with the smaller diameter comes into contact with the ends 3*e*, 11*b* of the yokes 3 and 11 respectively for each year when the month of February has 28 days, while the large-diameter portion of this cam 14 comes into contact with the said ends of the yokes 3 and 11 only in leap years, when the month of February has 29 days.

Figure 2:
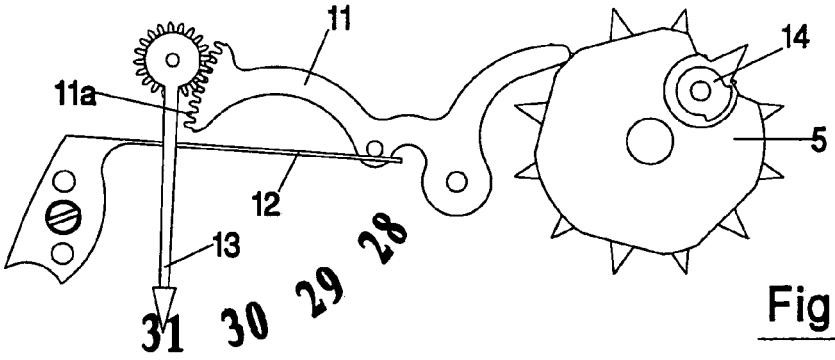
FIGS. 2 to 5 are partial views from above of the mechanism of FIG. 1, showing the means for operating a device for displaying the number of days in the month being displayed, in its four possible display positions.
Figure 3:
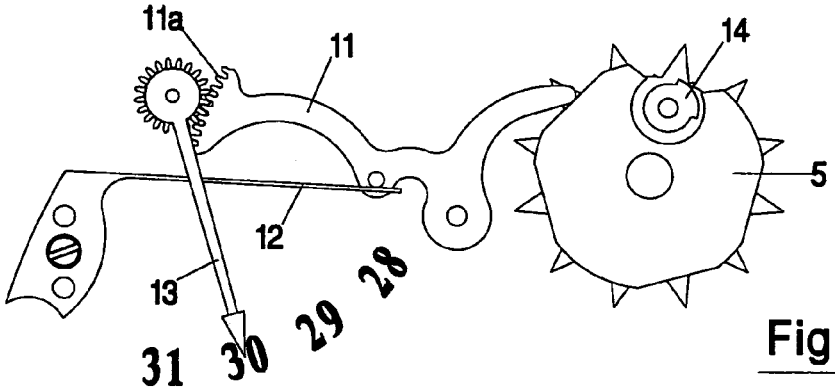
Figure 4:
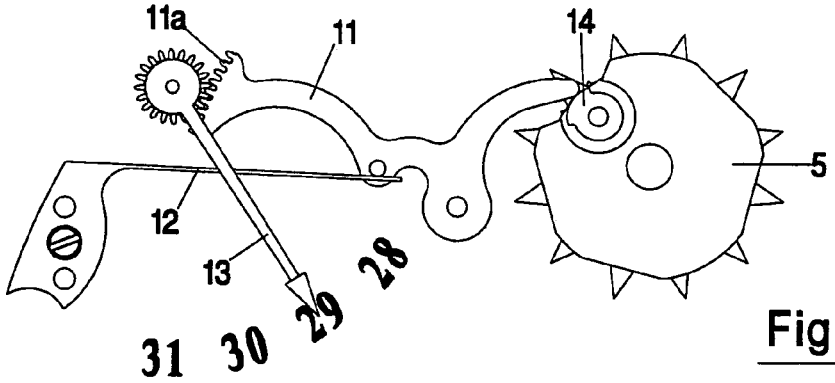
Figure 5:
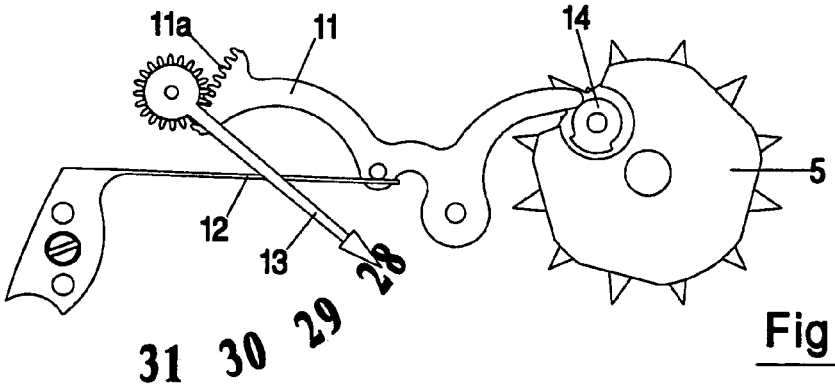

FIGS. 2 to 5 show the four positions which can be occupied by the indicator element 13 of the device for displaying the number of days in the month being displayed. Each of these angular positions corresponds to a number corresponding to the number of days in the month being displayed.

On each revolution of the operating wheel 1, the finger 2 drives a pin 3*f* of the large yoke 3. The position of this pin 3*f* varies according to the initial position of this large yoke 3 bearing against the year cam 5 or against the February cam 14. The amplitude of the large yoke 3 increases as the number of days decreases. Consequently, at the end of a month of less than 31 days, on the thirtieth day, the large pawl 3*c* enters the release part of the correction cam 7*a*, so that when the yoke 3 is driven by the finger 2 of the operating wheel 1 the date indicator moves directly from the 30th to the 1st of the next month. If the month has 29 days, the amplitude of the yoke 3 is even greater, and the large pawl enters the release part of the correction cam 7*a* on the 29th day and directly moves the date indicator from the 29th to the 1st. The same applies when the month has 28 days. Regardless of the number of days in the month, the large pawl 3 returns the date indicator to the number 1 for the start of the next month by driving the date wheel through one, two, three or four steps at once, according to whether the month has 31, 30, 29 or 28 days.

At the end of each movement of the date wheel by the large pawl 3*c* at the end of each month, the yoke 8 falls into the release part of the cam 7*b*, thus driving the year 10 wheel by one step. The yoke 3 occupies another position if the number of days in the next month changes, and the same applies to the second yoke 11 of the device for indicating the number of days in the month, causing the indicator element 13 to be positioned on the number corresponding to the number of days in the month being displayed.

The invention claimed is:

1. Timepiece comprising a annual or perpetual date display mechanism, comprising at least a month cam wherein this mechanism also comprises a movable member for indicating the number of days in the month, which can be moved with respect to at least one fixed indicator element, and a linkage for connecting this movable indicator member to the said month cam, so that the said movable member for indicating the number of days in the month occupies, with respect to the said fixed indicator element, during each month, a position characteristic of that of the said month cam.

2. Timepiece according to claim 1, in which the said display device is of the analogue type.

3. Timepiece according to claim 2, in which the linkage for connecting the said movable indicator member to the month cam comprises a driving yoke, a spring for pressing this driving yoke against the month cam and gearing whose teeth are fixed to the indicator member and to the said driving yoke respectively.

4. Timepiece according to claim 3, in which the said date display mechanism comprises a large driving yoke, a date indicator, and a spring for pressing this large yoke against the said month cam, to determine an angular rest position of this large driving yoke which is a function of the length of the month being displayed, and in which the respective pivot shafts of the said driving yoke of the said movable indicator member and of the said large driving yoke of the said date indicator are coaxial.

5. Timepiece according to claim 2, in which the said date display mechanism comprises a large driving yoke, a date indicator, and a spring for pressing this large yoke against the said month cam, to determine an angular rest position of this large driving yoke which is a function of the length of the month being displayed, and in which the respective pivot shafts of the said driving yoke of the said movable indicator member and of the said large driving yoke of the said date indicator are coaxial.

6. Timepiece according to claim 1, in which the linkage for connecting the said movable indicator member to the month cam comprises a driving yoke, a spring for pressing this driving yoke against the month cam and gearing whose teeth are fixed to the indicator member and to the said driving yoke respectively.

7. Timepiece according to claim 6, in which the said date display mechanism comprises a large driving yoke, a date indicator, and a spring for pressing this large yoke against the said month cam, to determine an angular rest position of this large driving yoke which is a function of the length of the month being displayed, and in which the respective pivot shafts of the said driving yoke of the said movable indicator member and of the said large driving yoke of the said date indicator are coaxial.

8. Timepiece according to claim 1, in which the said date display mechanism comprises a large driving yoke, a date indicator, and a spring for pressing this large yoke against the said month cam, to determine an angular rest position of this large driving yoke which is a function of the length of the month being displayed, and in which the respective pivot shafts of the said driving yoke of the said movable indicator member and of the said large driving yoke of the said date indicator are coaxial.

* * * * *